United States Patent [19]

Reyes, Jr.

[11] Patent Number: 4,842,158

[45] Date of Patent: Jun. 27, 1989

[54] CONTAINER HANDLE ATTACHMENT

[76] Inventor: Ruben Reyes, Jr., 5757 S. Staples Apt. 2816, Corpus Christi, Tex. 78413

[21] Appl. No.: 157,953

[22] Filed: Feb. 19, 1988

[51] Int. Cl.[4] ..... B65D 23/10; B65D 83/14

[52] U.S. Cl. ..... 220/94 R; 220/85 H; 220/96; 222/475; 215/100 A

[58] Field of Search ..... 220/85 H, 94 R, 96; 222/473, 475; 294/31.2, 34; 215/100 A; 16/114 R, 114 A

[56] References Cited

U.S. PATENT DOCUMENTS

| | | | |
|---|---|---|---|
| 1,242,994 | 10/1917 | Skiff | 16/114 R |
| 1,373,695 | 4/1921 | Wright | 215/100 A |
| 3,719,305 | 3/1973 | Pressnell | 220/85 H |
| 3,794,370 | 2/1974 | Lockhart et al. | 294/31.2 |
| 4,089,440 | 5/1978 | Lee | 222/473 |
| 4,094,449 | 6/1978 | Schlegel et al. | 222/475 |
| 4,379,578 | 4/1983 | Schuler | 294/31.2 |
| 4,456,135 | 6/1984 | Beekes | 220/94 R |
| 4,555,034 | 11/1985 | Gerhards | 215/100 R |
| 4,579,258 | 4/1986 | Brown et al. | 222/473 |
| 4,643,326 | 2/1987 | Klingler | 220/94 R |
| 4,666,197 | 5/1987 | Watson et al. | 215/100 A |

FOREIGN PATENT DOCUMENTS

| | | | |
|---|---|---|---|
| 178280 | 7/1905 | Fed. Rep. of Germany | 220/85 H |
| 351083 | 2/1961 | Switzerland | 220/94 R |
| 14937 | of 1892 | United Kingdom | 16/114 R |

*Primary Examiner*—Harvey C. Hornsby
*Assistant Examiner*—Christine A. Peterson
*Attorney, Agent, or Firm*—Jerry T. Kearns

[57] ABSTRACT

A container handle attachment designed for use with disposable two and three liter plastic beverage containers, has a threaded spout with an integrally formed handle. A strap adapted to be received around the container is received through a slot in an end portion of the handle. The strap is provided with a buckle type fastener for securement around the disposable container. The threaded spout is provided with a pivotal closure seal which is spring biased to a closed position. In a second embodiment, an elongated handle mounting bar is formed integrally with the threaded spout and is adapted to extend along the length of the disposable container. A pair of VELCRO fastening strips are received through spaced slots in the handle mounting bar. The VELCRO straps are adapted to be secured around the disposable container. A handle is mounted for selective sliding adjustable movement along the length of the handle mounting bar, to compensate for the changing center of mass of the container as the contents are utilized.

1 Claim, 4 Drawing Sheets

CONTAINER HANDLE ATTACHMENT

BACKGROUND OF THE INVENTION

1. Field of the Invention

The present invention relates to container handle attachments, and more particularly pertains to a container handle attachment designed for use with two and three liter disposable plastic bottles of the type utilized to package beverages. These disposable beverage bottles are large and quite heavy when full. It is difficult, especially for older individuals and small children, to dispense a desired quantity of the contents from one of these bottles. Additionally, these bottles are provided With screw on caps which must be repeatedly removed and replaced after each use. In order to overcome these problems, the present invention provides a handle attachment with an integral screw on spout provided With a spring closure for attachment to these disposable beverage bottles.

2. Description of the Prior Art

Various types of container handle attachments are known in the prior art. A typical example of such a container handle attachment is to be found in U.S. Pat. No. 3,719,305, which issued to D. Pressnell on Mar. 6, 1973. This patent discloses a holder for holding a beverage can in such a manner that one may use the holder as a stein in drinking the beverage from the can. The holder includes a dish for supporting the can, a post extending upwardly of the dish, a handle pivoted to the top of the post and a bar slidably mounted for inward-outward movement in the top of the post. A latch at the bottom of the handle extends through a slot on the post and bears against the can to restrain the can against movement on the dish. U.S. Pat. No. 3,794,370, which issued to B. Lockhart et al on Feb. 26, 1974, discloses a handle for a thermos bottle which is secured by a pair of spaced adjustable straps which encircle the thermos bottle and can be drawn tight by utilizing the elasticity of the plastic material from which the straps are formed. The straps have a plurality of attaching apertures of a generally rectangular configuration and the body of the handle has a serpentine passage with generally rectangular teeth formed centrally thereof The strap is fed through the serpentine passage and pulled taut with a portion of the apertures engaged over the teeth. The teeth each have a sloping face in the direction from which the strap is moving when being tightened with the opposite face perpendicular to prevent withdrawal of the strap. U.S. Pat. No. 4,456,135, which issued to H. Beekes on June 26, 1984, discloses a handle and reseal for disposable plastic beverage containers. A handle has a circular mounting ring provided with tabs which engage the flange on the neck of the bottle. A pivotal closure attached to the mounting ring is provided with a locking mechanism for resealing the bottle. U.S. Pat. No. 4,555,034, which issued to L. Gerhards on Nov. 26, 1985, discloses a beer mug formed of the mug container and a lid made out of wood. The lid is hingedly connected to the handle secured to the mug container and can be releasably attached to the handle by a snapping connecting device Which includes a connecting element of an elastic plastic on the lid and a hinge mounted on the handle and provided with a pivot which can be snapped into a slot formed on the end portion of the elastic connecting element. U.S. Pat. No. 4,666,197, which issued to W. Watson et al on May 19, 1987, discloses a bottle holder for use with disposable plastic soft drink bottles having a wide body and a narrow neck formed with an annular flange. The bottle holder has a lower annular band which fits snugly over the bottom of the bottle, an upper aperture gripping member which fits over the flange, and a handle which connects the upper gripping member and lower band. The handle is formed with an integral hinge portion which permits the lower band to be folded into the handle to form a flat member for packaging and storage.

While the above mentioned devices are suited for their intended usage, none of these devices discloses a handle attachment designed for use with disposable plastic beverage bottles having a threaded spout with an integral handle provided with a strap for securement around the bottle. Additionally, none of the aforesaid devices provide a handle attachment for a disposable plastic beverage container which allows the handle position to be adjusted to compensate for the changing center of mass of the bottle, as the bottle contents are utilized. Inasmuch as the art is relatively crowded with respect to these various types of container handle attachments, it can be appreciated that there is a continuing need for and interest in improvements to such container handle attachments, and in this respect, the present invention addresses this need and interest.

SUMMARY OF THE INVENTION

In view of the foregoing disadvantages inherent in the known types of container handle attachments now present in the prior art, the present invention provides an improved container handle attachment. As such, the general purpose of the present invention, wbich will be described subsequently in greater detail, is to provide a new and improved container handle attachment which has all the advantages of the prior art container handle attachments and none of the disadvantages.

To attain this, representative embodiments of the concepts of the present invention are illustrated in the drawings and make use of a threaded spout with an integrally formed handle. A strap adapted to be received around a disposable plastic beverage container is received through a slot in an end portion of the handle. The strap is provided with a buckle type fastener for securement around the disposable container. The threaded spout is provided with a pivotal closure seal which is spring biased to a closed position. In a second embodiment, an elongated handle mounting bar is formed integrally with the threaded spout and is adapted to extend along the length of the disposable container. A pair of VELCRO fastening strips are received through spaced slots in the handle mounting bar. The VELCRO straps are adapted to be secured around the disposable container. A handle is mounted for selective sliding adjustable movement along the length of the handle mounting bar, to compensate for the changing center of mass of the container as the contents are utilized.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container handle attachment which has all the advantages of the prior art container handle attachments and none of the disadvantages.

It is another object of the present invention to provide a new and improved container handle attachment which may be easily and efficiently manufactured and marketed.

It is a further object of the present invention to provide a new and improved container handle attachment which is of a durable and reliable construction.

An even further object of the present invention is to provide a new and improved container handle attachment which is susceptible of a low cost of manufacture with regard to both materials and labor, and which accordingly is then susceptible of low prices of sale to the consuming public, thereby making such container handle attachments economically available to the buying public.

Still yet another object of the present invention is to provide a new and improved container handle attachment which provides in the apparatuses and methods of the prior art some of the advantages thereof, while simultaneously overcoming some of the disadvantages normally associated therewith.

Still another object of the present invention is to provide a new and improved container handle attachment for use with two and three liter plastic disposable beverage containers which provides a pouring spout having a spring biased bottle closure.

Yet another object of the present invention is to provide a new and improved container handle attachment designed for use with two or three liter disposable plastic beverage bottles having a screw on pouring spout with an integrally formed handle.

Even still another object of the present invention is to provide a new and improved container handle attachment for use with two and three liter disposable plastic beverage containers having an adjustable handle to compensate for the bottle's changing center of mass, as the bottle contents are utilized.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
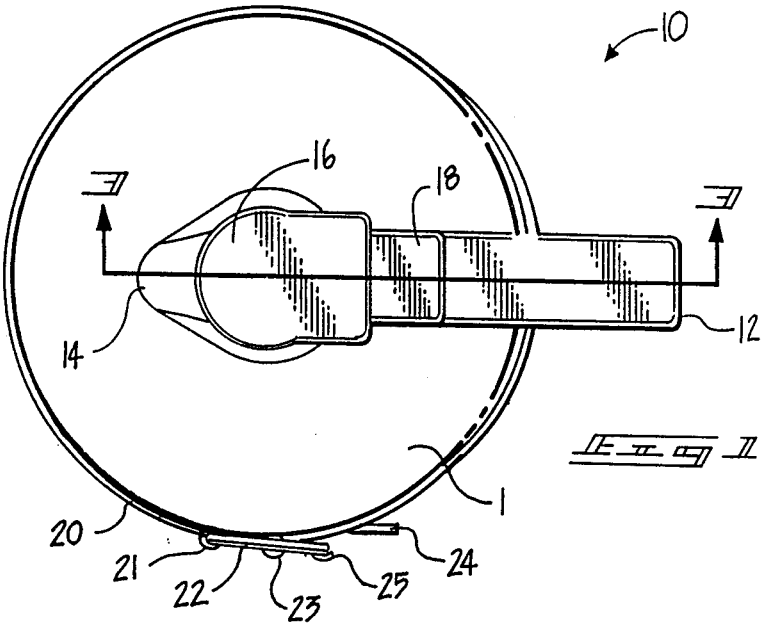
FIG. 1 is a top view of a bottle provided with the handle attachment according to a first embodiment of the present invention.

With reference now to the drawings, and in particular to FIG. 1 thereof, a new and improved container handle attachment embodying the principles and concepts of the present invention and generally designated by the reference numeral 10 will be described.

More specifically, it will be noted that the first embodiment 10 of the invention includes an arcuate handle 12 which is connected at 28 to a screw on pouring spout 14. The pouring spout 14 is provided with a pivotal closure 16 having an integral thumb operating tab 18. An attaching strap 20, which extends through a slot 26 at an end portion of the handle 12, is secured around the plastic disposable beverage bottle 1. The bottle 1 may be of the two or three liter type of bottle utilized to package soft drinks. The attaching strap 20 has a first end loop 21 which mounts a rectangular buckle loop 22 for pivotal movement. A second pivotal connection loop 23, provided on an opposite end of the strap 20, mounts a buckle tab 24. The buckle tab 24 has an integrally formed hook 25 for engagement with the rectangular buckle loop 22. The strap 20 is formed from an elastic or resilient plastic material and is slightly stretched when the buckle tab 24 is in a closed position.

Figure 2:
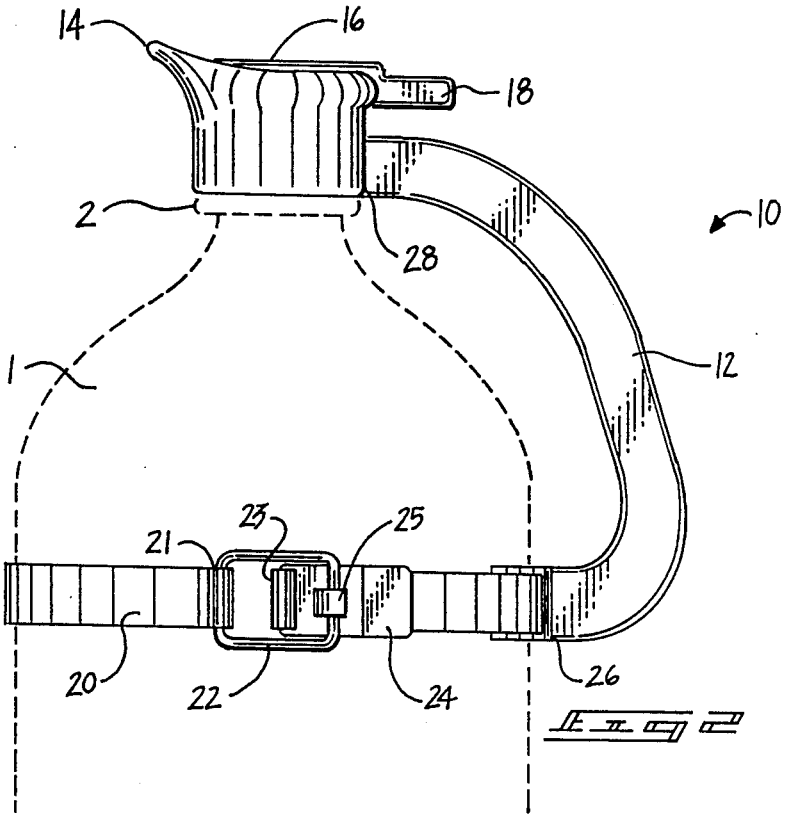
FIG. 2 is a side view of a bottle provided with the handle attachment according to the first embodiment of the present invention.

FIG. 2 illustrates a side view of the first embodiment 10 of the present invention. In use, the originally provided screw on cap of the bottle 1 is removed and discarded. The threaded pouring spout 14 is then secured on the threaded neck 2 of the bottle 1 The strap 20 is then positioned around the wide body portion of the bottle 1 and the buckle loop 22 is positioned in engagement with the buckle tab hook 25. The buckle tab 24 is then pivoted to the illustrated closed position. A user may then dispense the desired quantity of the contents of the bottle 1 by grasping the handle 12 and tipping the bottle. The thumb closure opening tab 18 is then depressed, allowing the contents to pour from the spout 14. Upon releasing of the tab 18, the closure 16 will snap to a closed position, by virtue of an internal spring bias, thus sealing the contents within the bottle 1.

Figure 3:
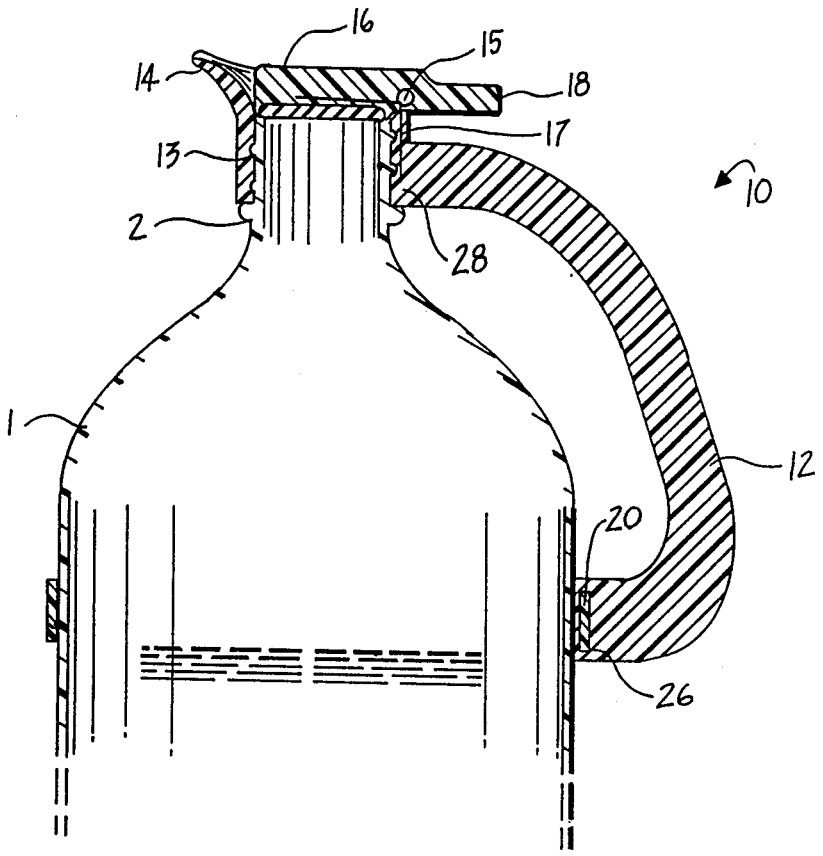
FIG. 3 is a cross sectional view, taken along line 3—3 of FIG. 1.

As shown in the cross sectional view of FIG. 3, a spring 17 positioned around a pivot pin 15 urges the closure 16 to a closed position. Internal threads on the spout 14 engage with the threads provided on the neck 2 of the bottle 1. The attaching strap 20 extends through a slot 26 provided adjacent an end portion of the handle 12.

Figure 4:
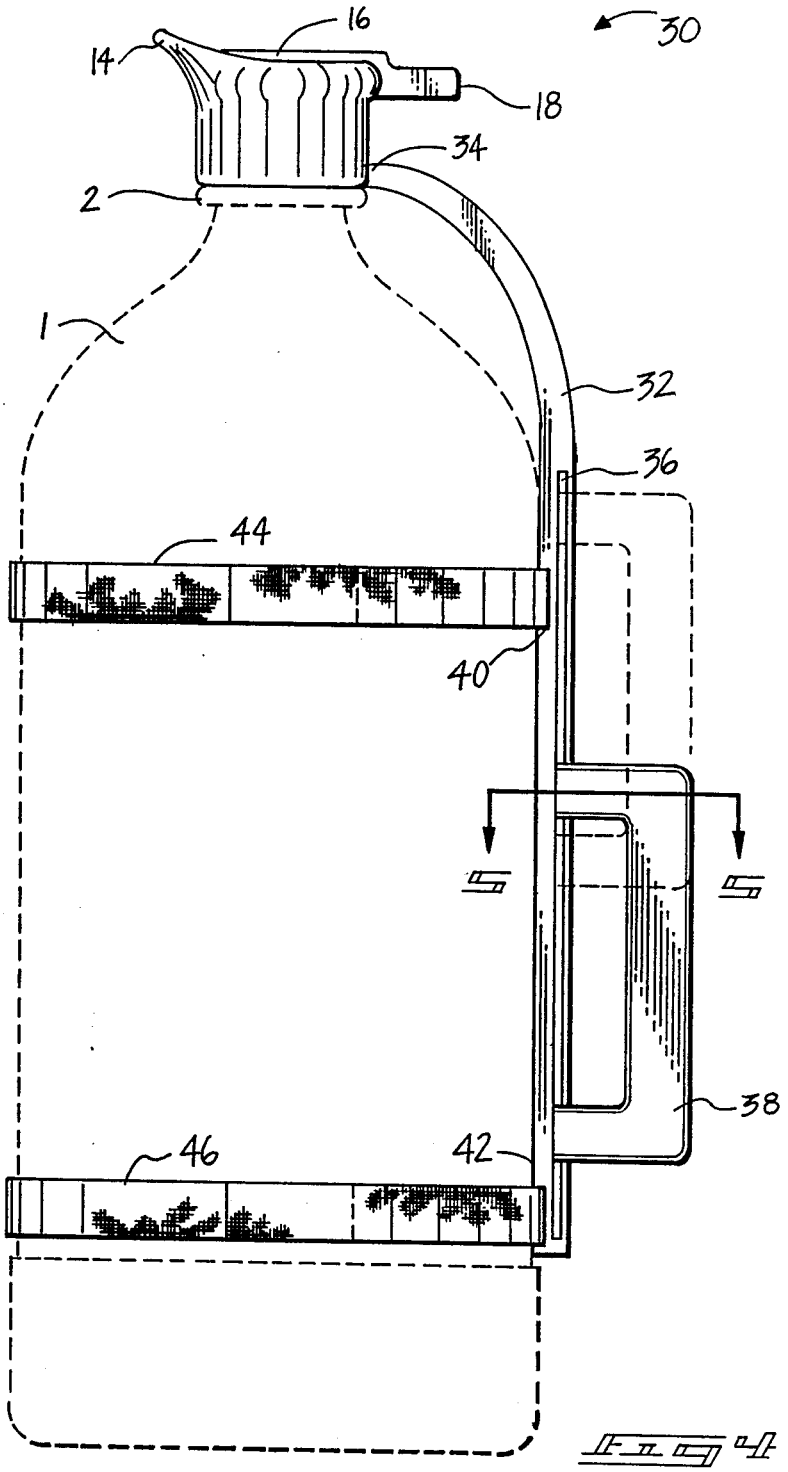
FIG. 4 is a side view of a bottle provided with the handle attachment according to a second embodiment of the present invention.

With reference now to FIG. 4, a second embodiment of a container handle attachment according to the present invention will now be described. More specifically, it will be noted that the second embodiment 30 of the invention includes a screw on spout 14 having a closure 16 provided with a thumb operating tab 18. These elements are identical with those described in conjunction with the first embodiment 10 of the present invention. An elongated handle mounting bar 32 is connected at 34 to the pouring spout 14. The bar 32 extends longitudinally down the length of the bottle 1. A pair of spaced transverse slots 40 and 42 are provided through the handle mounting bar 32 for the reception of a pair of spaced VELCRO fastening straps 44 and 46. These straps 44 and 46 serve to secure the handle mounting bar 32 to the bottle 1. A longitudinal groove 36 is formed in each side wall of the mounting bar 32. A handle 38 has complimentary configured projections received in the groove 36. Frictional engagement of the handle 38 with the grooves 36 of the mounting bar 32 allows the handle 38 to be selectively positioned along the length of the bottle 1. The handle 38 may be easily moved to the desired position, but will remain in the adjusted position due to a close tolerance fit of the handle 38 with the grooves 36. As shown in dotted lines, the handle 38 may be slid along the length of the mounting bar 32. This allows a user to position the handle 38 to compensate for the changing center of mass of the bottle 1, as the contents of the bottle are utilized.

Figure 5:
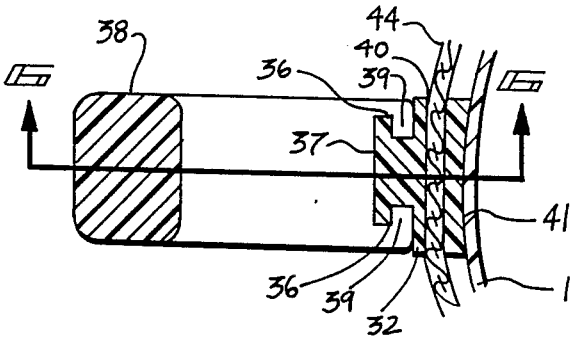
FIG. 5 is a cross sectional view, taken along line 5—5 of FIG. 4.

As shown in the cross sectional view of FIG. 5, the handle mounting bar 32 is provided with a slot 40 through which the upper attachment strap 44 extends. The handle mounting bar 32 is also provided with a pair of longitudinal grooves 36 which extend along each side of the mounting bar 32. These grooves 36 form a "T"-shaped projection 37 on the mounting bar 32. The handle 38 is provided with a cooperating "T"-shaped recess which forms a pair of radially inwardly projecting ribs 39 which are received for sliding movement in the slots 36. This configuration allows the handle 38 to be slid along the length of the mounting bar 32, as previously described. The inner surface of the mounting bar 32 is provided with a radiused concave contour 41 for complimentary engagement with the curved outer surface of the bottle 1.

Figure 6:
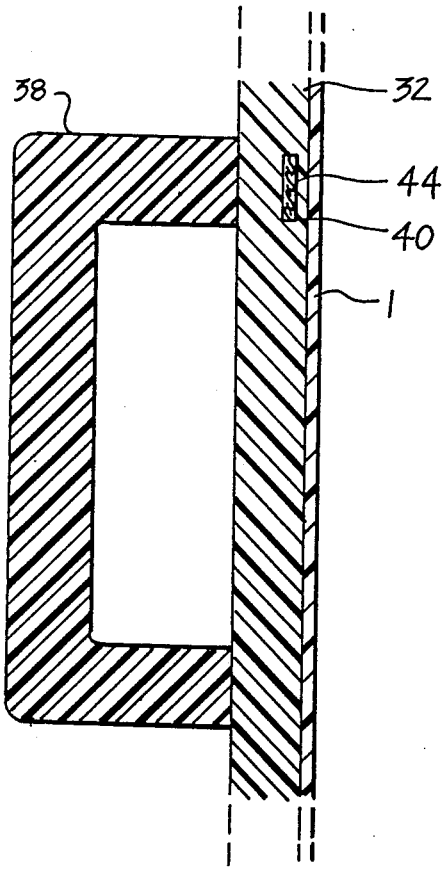
FIG. 6 is a cross sectional view taken along line 6—6 of FIG. 5.

In FIG. 6, a cross sectional view taken along line 6—6 of FIG. 5 is provided, which illustrates the handle 38 secured for sliding movement along the mounting bar 32.

Figure 7:
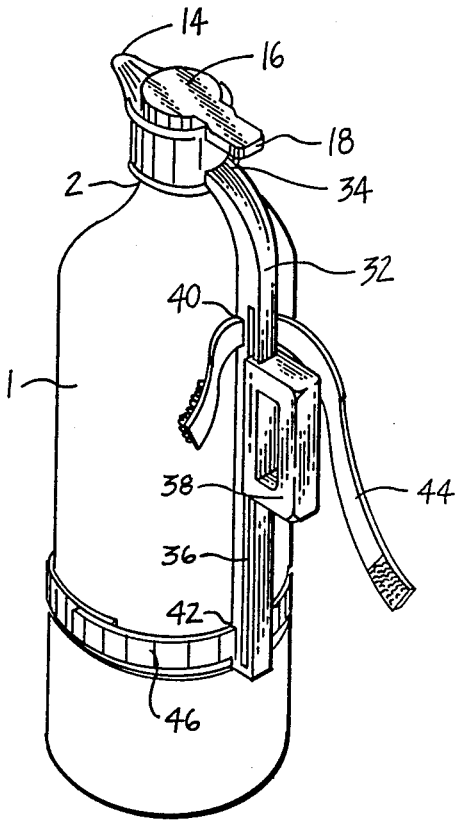
FIG. 7 is a perspective view of a bottle provided with the container handle attachment of the second embodiment of the present invention.

In FIG. 7, a perspective view is provided wbich illustrates the container handle attachment 30 according to the second embodiment of the present invention.

It is to be understood that the first embodiment 10 and second embodiment 30 of the present invention may be formed in a variety of sizes to fit a variety of conventional disposable plastic beverage containers. The container handle attachment of the present invention allow beverage containers to be easily transported and stored and also allow individuals to easily dispense a desired quantity of the contents from a bottle. Additionally, the present invention allows the contents of the bottle to be resealed, without necessitating the reapplication of the original screw on closure.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters Patent of the United States is as follows:

1. A container handle attachment, comprising:
internally threaded spout means;
pivotal closure means on said spout means;
an elongated handle mounting bar having a first end integrally formed with said spout means;
a pair of elongated grooves extending along opposite side walls of said mounting bar;
a generally U-shaped handle having a pair of free ends each provided with a "T"-slot groove forming opposed inwardly extending ribs received for sliding movement in said mounting bar side wall grooves;
a pair of spaced transverse slots in said mounting bar;
an elongated strap extending through each of said transverse slots; and
a pair of elongated straps, each extending through one of said transverse slots, and each having opposite ends provided with cooperating hook and loop fasteners for securing said straps around a container.

* * * * *